United States Patent [19]

Hoffman et al.

[11] 4,159,211

[45] Jun. 26, 1979

[54] DISHWASHER WATER TEMPERATURE CONTROL SYSTEM

[75] Inventors: Robert E. Hoffman, Dayton; Richard B. Williams, Kettering; Carl J. Wright, Bellbrook, all of Ohio

[73] Assignee: General Motors Corporation, Detroit, Mich.

[21] Appl. No.: 932,665

[22] Filed: Aug. 10, 1978

Related U.S. Application Data

[63] Continuation-in-part of Ser. No. 851,438, Nov. 14, 1977, abandoned.

[51] Int. Cl.[2] ..... B08B 3/02

[52] U.S. Cl. ..... 134/57 D; 134/108; 68/12 R; 137/341

[58] Field of Search ..... 134/57 D, 58 D, 107, 134/108; 68/12 R; 137/334, 341

[56] References Cited

U.S. PATENT DOCUMENTS

| | | | |
|---|---|---|---|
| 3,186,471 | 6/1965 | Fay | 134/57 D |
| 3,835,880 | 9/1974 | Hoffman et al. | 134/57 D X |
| 3,846,615 | 11/1974 | Athey et al. | 134/57 D X |
| 3,861,413 | 1/1975 | Woehler | 137/334 |
| 3,911,943 | 10/1975 | Athey et al. | 137/341 |
| 3,923,073 | 12/1975 | Jacobs | 134/57 D |

*Primary Examiner*—Robert L. Bleutge
*Attorney, Agent, or Firm*—Edward P. Barthel

[57] ABSTRACT

A domestic dishwasher is provided with a control system having circuitry including timer switch means adapted to insure automatic wash water at a normal set temperature for all cycles with the user having an option to preselect an elevated wash water temperature. During wash periods, power for the heater is provided through timer switch means connected through a first thermostat whereby if the water in the chamber is below its set temperature, the first thermostat will energize a heater to provide auxiliary heat to the wash water. The timer switch means is operative to stop the timer motor until the water is heated to said set temperature. Once the water reaches the minimum set temperature, or if the water supply is initially above said minimum setting the first thermostat will switch, deenergizing the heater. If an extra hot wash option is selected by an Options Selector Switch, and the water temperature is below a second thermostat's elevated set point, the timer switch means will stop the timer motor providing extended heating until the second thermostat closes upon the water reaching the elevated temperature.

3 Claims, 6 Drawing Figures

TIME CYCLE CHART

DISHWASHER WATER TEMPERATURE CONTROL SYSTEM

This is a Continuation-in-Part of Ser. No. 851,438, filed Nov. 14, 1977, now abandoned.

This invention relates to a dishwasher control system and more particularly, to an improved heating control system which insures that the water temperature within the dishwashing chamber reaches a predetermined minimum effective temperature with the operator having an option for preselection of an extra hot wash.

Prior art dishwasher systems have provided a heating cycle set for a predetermined time to heat the water to a first temperature and an optional switch which allows the operator to prolong the heating cycle to insure the water reaches an elevated temperature such as 150° F. An example of such a dishwasher heating circuit is found in U.S. Pat. No. 3,861,413 to Woehler, issued Jan. 21, 1975.

It is an object of the present invention to provide an improved dishwasher control system with a first thermostat switch having a setting to energize a heater insuring a minimal wash water temperature for effective detergent action as well as supplying heat during timed cycles if the temperature of the water is below said setting, and wherein extra hot wash water may be selected by an options selector switch which, when activated, allows the heater to raise the wash water to an elevated second temperature determined by the setting of a second thermostat. During the wash periods power for the heater is provided through timer switch means whereby if the water temperature entering the dishwasher tub is above a minimal water temperature the first thermostat will switch, such that the timer will continue to run. With an entering water supply below the first thermostat setting the heater will supply auxiliary heat during interruption of the timer until the first thermostat switches the heater off and reenergizes the timer. The circuit provides a preselectable Extra Hot Wash by means of a second thermostat controlled by the option selector switch, whereby the timer motor advancement will stop in the same manner as for the normal wash cycle until the wash water attains the higher predetermined temperature setting of the second thermostat. Thus, in the disclosed forms the control system provides automatic wash water of 130° F. on all cycles with the option of the user to select 150° F. wash water.

Further objects and advantages of the present invention will be apparent from the following description, reference being had to the accompanying drawings wherein preferred embodiments of the present invention are clearly shown.

Figure 1:
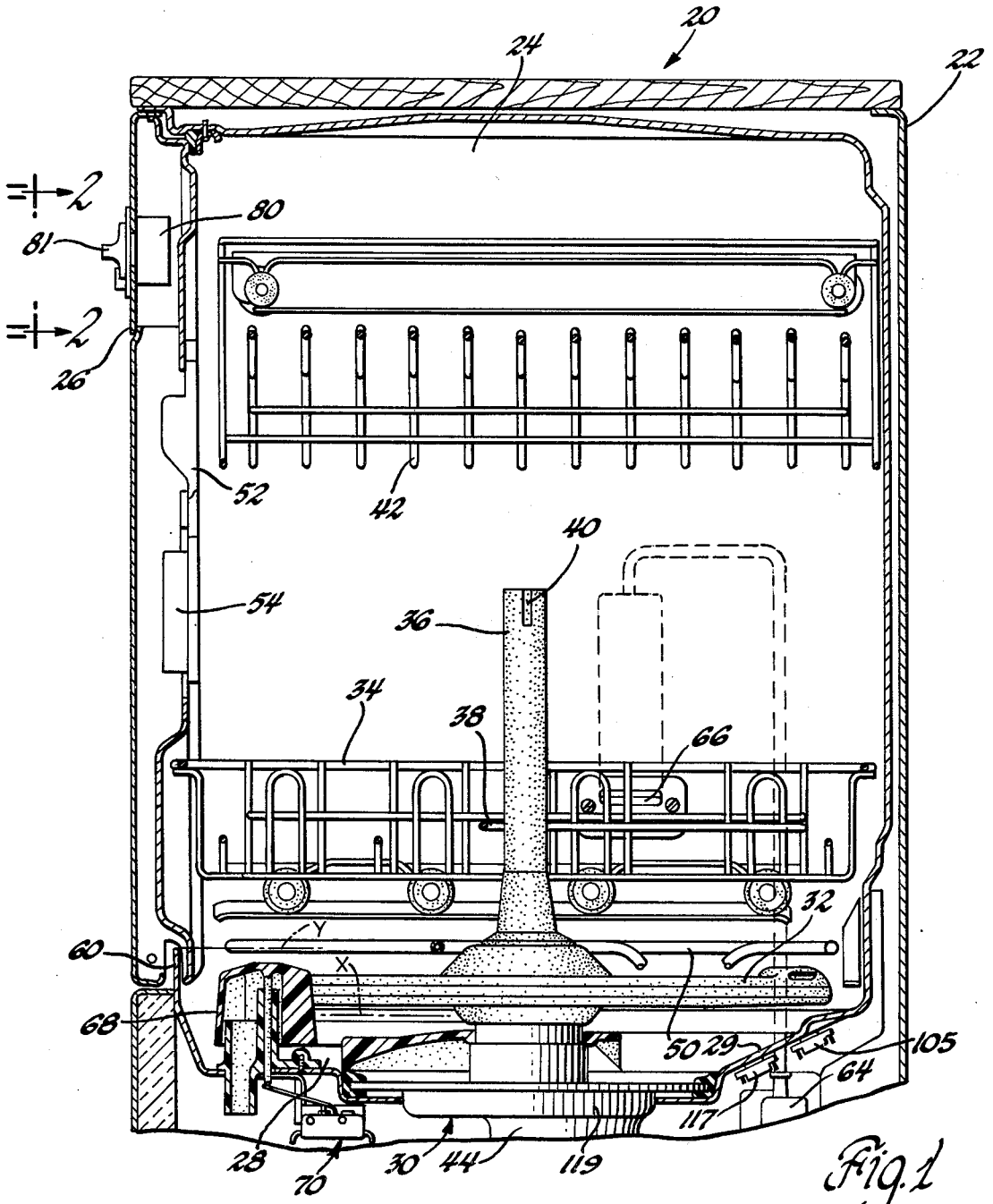
FIG. 1 is a side sectional view of a domestic dishwasher provided with the heater control system of this invention.

In accordance with this invention and with reference to FIG. 1, an improved dishwasher is illustrated generally at 20. The dishwasher 20 is comprised of a casing means 22 defining a dishwashing chamber 24 closed at the front thereof by dishwasher door 26 and having at the bottom thereof a depressed sump 28 leading to a pump motor assembly 30 which may be of the type taught in U.S. Pat. No. 3,265,311, issued Aug. 9, 1966.

In general, the water distribution system includes a revolvable spray arm 32 beneath the lower rack 34 and a rotating spray column or spray tube 36 affixed to said spray arm and extending upwardly through a guard portion 38 of the lower rack facilitating removal of the lower rack from the dishwashing chamber. The spray tube has an outlet 40 adapted to project a spray generally upwardly through the support wire network of an upper dish rack 42.

A reversible motor 44 in the pump motor assembly 30 directly drives the pump in one direction (WASH winding energized) to recirculate the water for washing or rinsing, and, when reversed, (DRAIN winding energized), pumps the water to drain. A heater 50 is periodically energized throughout the timed operating cycle to provide recovery heat to the wash and rinse water and for adding heat to the wash chamber for the drying cycle.

Figure 3:
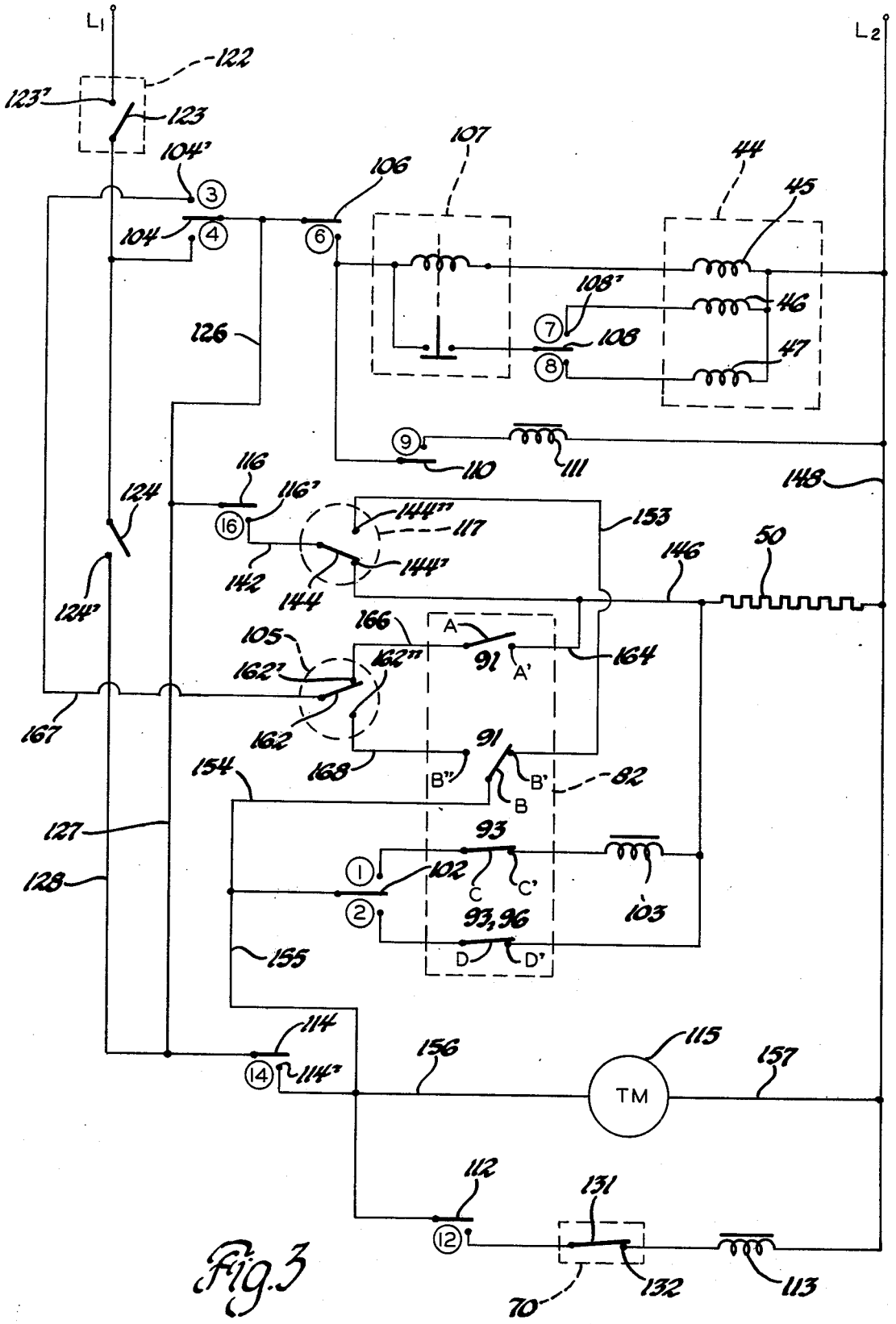
FIG. 3 is a schematic wiring diagram for the dishwasher of FIG. 1 including one form of applicants' circuit.
Figure 4:
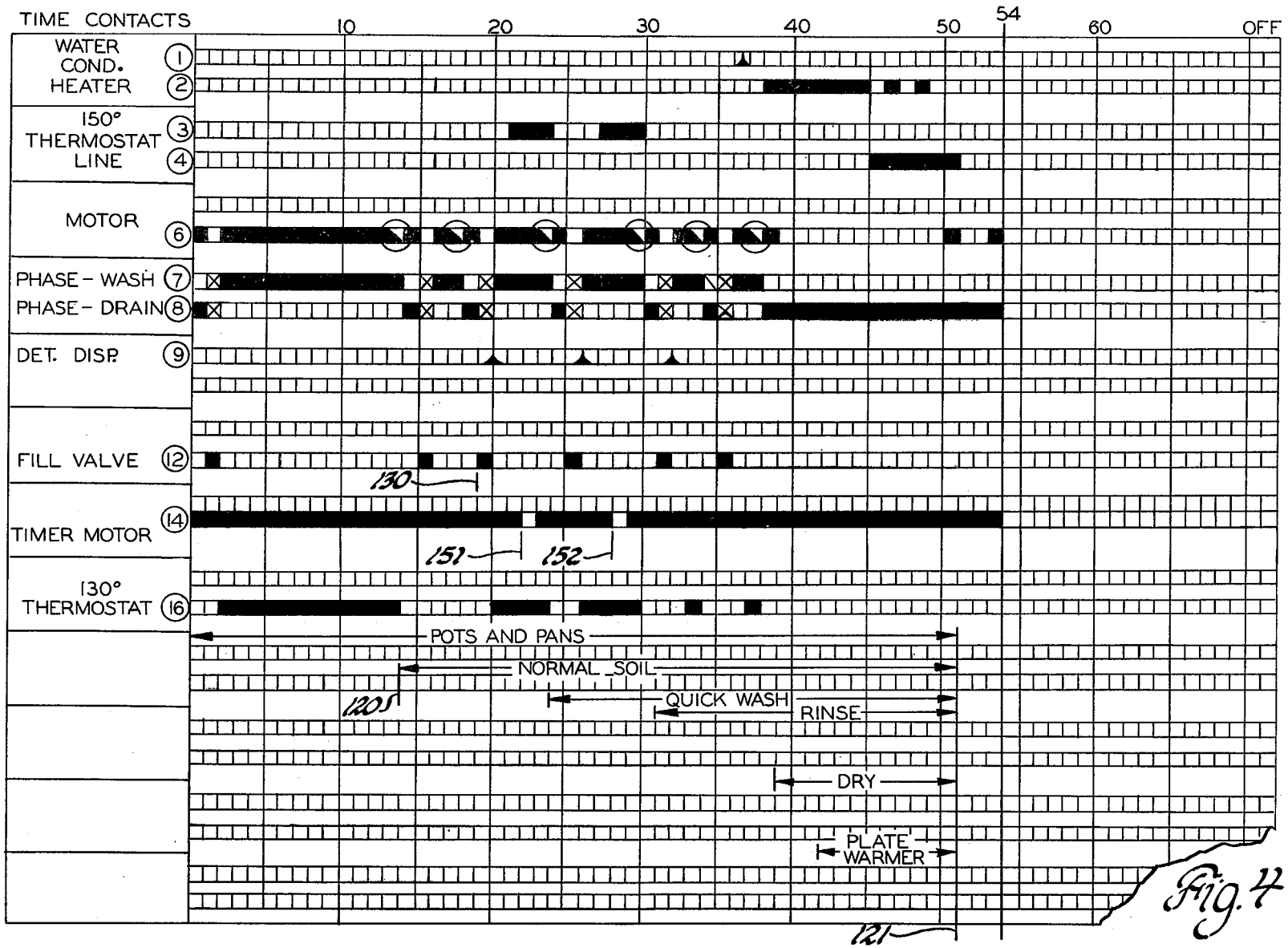
FIG. 4 is a timer cycle chart showing the functional relationships of the timer switches in FIG. 3.

Various dispensers are periodically energized throughout the dishwashing cycle for providing desired washing or rinsing agents at effective points in the operating cycle represented by the timer cycle chart of FIG. 4. For instance, and with reference to FIG. 1, a solenoid actuated detergent dispenser 52 and a solenoid actuated water conditioner dispenser 54 may be positioned on the inside panel of the dishwasher door 26 and electrically actuated through the control circuit of FIG. 3.

The dishwasher sump 28 is sized to contain a predetermined quantity of water which, for example, may be substantially 2.7 gallons of water standing in a quiescent state at a normal fill level "X" as described in U.S. Pat. No. 3,835,880 to Hoffman et al and assigned to the assignee of the present application.

In accordance with the Hoffman patent, however, sump 28 is also formed with a raised ledge or wall 60 defining along the upper edge thereof an overflow level "Y" where the sump capacity is about 5 gallons.

Water is supplied to sump 28 by means of a solenoid actuated water fill valve 64, controlled by timer switch twelve, through an opening 66 in the dishwashing chamber 24. As set forth in the Hoffman patent, specifications for fill valve 64 call for a supply of water at a set rate which, for example, may be at the rate of 1.6 gallons per minute from a domestic water supply having supply pressures between 20 pounds per square inch (psi) and 120 psi. Located in the sump 28 may be a suitable shut-off device, such as float 68 operated overfill switch 70, the details of which are disclosed in copending U.S. Application Ser. No. 853,318 to Woolley, et al. As explained in the Woolley patent application, the switch 70 deenergizes fill valve 64 when the normal fill level is exceeded by a predetermined overfill head intermediate water levels "X" and "Y".

Figure 2:
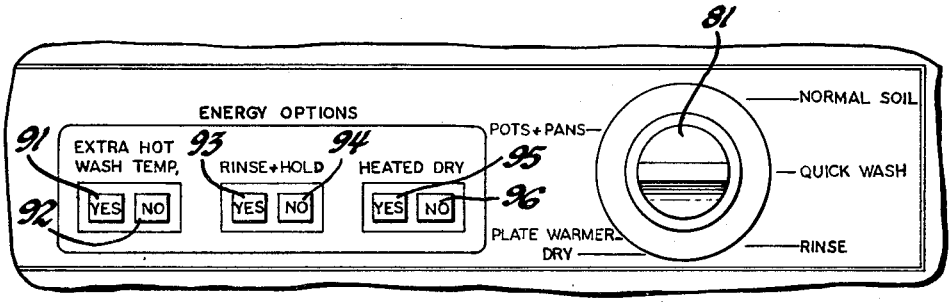
FIG. 2 is a fragmentary view of the Energy Options portion of the control panel of the dishwasher shown in FIG. 1.

The dishwashing cycle of dishwasher 20 is controlled by suitable timer means such as a door mounted timer 80 having actuating means. In the disclosed form the timer 80 is shown in FIG. 2 with a rotatable manual control knob 81 settable to provide a series of complete dishwasher cycles entitled "POTS AND PANS", "NORMAL SOIL", QUICK WASH", "RINSE", "DRY" and "PLATE WARMER".

In accordance with FIG. 3, it should be understood that the various internal switches A, B, C and D within the dashed outline of option selector switch 82 move to a position opposite that shown when the option button is selected which bears the number 91–96 (FIG. 2) shown for each of the four internal switches A–D. Thus, single pole-single throw switch A and single pole-double throw switch B move to their opposite positions when EXTRA HOT-YES button 91 is depressed; single pole-single throw switches C and D move to their opposite positions when RINSE AND HOLD-YES button 93 is depressed; and switch D moves to its opposite position when HEATED DRY-NO button 96 is depressed.

Timer contacts listed in FIG. 4 are shown circled in FIG. 3. Thus, timer 80 includes a timer switch 102 operating between water conditioner solenoid 103 timer contact "one" and heater 50 timer contact "two"; a timer switch 104 operating between a second 150° thermostat 105 timer contact "three" and a line contact "four"; timer switch 106 operating to open and close starting relay 107 contact "six"; timer switch 108 operating between motor phase-wash winding 46 timer contact "seven" and motor phase-drain winding 47 timer contact "eight"; timer switch 110 operative to open and close timer detergent dispenser solenoid 111 contact "nine"; timer switch 112 operative to open and close timer fill valve solenoid 113 contact "twelve"; timer switch 114 operative to open and close timer motor 115 contact "fourteen"; and timer switch 116 operative to open and close a first 130° thermostat 117 timer contact "sixteen".

The reversible motor 44 main winding 45 directly drives pump 119 in one direction by means of wash winding 46 being energized to recirculate the water for washing or rinsing. When the motor is reversed by means of drain winding 47 being energized the motor 44 pumps the water to drain.

The invention will be described in connection with the fill system accompanying the selection of the NORMAL SOIL cycle beginning with chart line 120 on the timer cycle chart of FIG. 4 and terminating at OFF indicated by chart line 121. The dishwashing cycle is initiated through the door switch 122 movable contact 123 which closes to its contact 123' when the door 26 is closed. Upon the timer knob 81 being rotated to its NORMAL SOIL position and pushed-in, a push-pull switch 124 is closed to its fixed contact 124'. With timer switch 114 closed to its fixed contact 114' at chart line 120, timer motor 115 is energized from $L_1$, door switch 122, push-pull switch 124 and timer motor switch 114. Thus, power supply conductor 128 remains energized throughout the NORMAL SOIL cycle for supplying power to timer motor 115 and, if needed, water valve solenoid 113. At first, pump motor 44 will be operated in the drain direction, timer switch 108 closed to its lower contact "eight" for purging the sump of stagnant water. At cycle chart line 130 timer switch 112 closes to the contact "twelve" to energize water valve 64 solenoid 113 through water level overfill switch 70. As discussed earlier the water level switch movable contact 131 is normally closed to its fixed contact 132 except when the level of water in sump 28 exceeds the normal fill level "X" by a predetermined overfill level.

Fill water will start to enter the sump through inlet 66. Applicants' system insures that the temperature of the water in the sump 28 is heated to a minimum first set temperature in the event that the water supplied to the sump is below said first set temperature. In the disclosed embodiment the first single pole-double throw thermostat 117 is shown located on sump wall 29 to sense for a minimum first set water temperature 130° F. in the sump 28.

During wash and rinse periods, power for the heater 50 is provided through timer contact "sixteen" switch 116 connected by line 142 to movable switch 144 of thermostat 117 contacting its lower second fixed contact 144'. In this way if the water temperature in the sump 28 is below 130° F. a circuit is completed via a path from $L_1$, line 126, timer switch 116 closed to its contact 116', line 142, first thermostat switch 144, line 146, heater 50 and line 148 to the $L_2$ side of the power source to provide auxiliary heat to the wash and rinse water. Once the wash or rinse water reaches 130° F., either by being initially above 130° F. or warmed by heater 50, the first thermostat 117 will "open" by moving its switch 144 to its upper first contact 144" interrupting power to the heater 50.

It will be noted in the timer cycle chart of FIG. 4 that for either the POTS AND PANS, NORMAL SOIL OR QUICK WASH periods, at chart lines 151 and 152 respectively, timer motor contact "fourteen" switch 114 is open and timer motor contact "sixteen" switch 116 is closed. Thus, switch 114 interrupts power to the timer motor 115, resulting in a stoppage of any further timer advancement through either wash program. If the first 130° F. thermostat 117 is contacting its lower fixed contact 144', power will be fed only to the heater 50 through switch 116 closed to its contact 116'. Upon the wash water reaching 130° F. the first thermostat switch 144 closes to its upper fixed contact 144" whereby power is again supplied to the timer motor 115 via line 153 through the options selector switch B closed to its fixed contact B' and lines 154, 155, line 156, timer motor 115, and thence via lines 157 and 148 to the $L_2$ side of the power source. It will be noted that the above sequence occurs when the options selector switch 82 has its push button 92 depressed.

If the options selector switch 82 EXTRA HOT WASH TEMP button 91 is depressed the option selector switch A closes to its contact A' and switch B moves from its contact B' to B" whereby the timer motor advancement will be halted at the same points on the timer chart as described above. That is to say that with the options switch button 91 depressed, the hold condition will be extended until the wash water arrives at a second higher temperature which in the disclosed form is set by the second thermostat 105 at 150° F. This results from second thermostat 105 switch 162 being in engagement with its first fixed contact 162' whereby heater 50 will be energized via line 148 from the $L_2$ side of the power source, heater 50, line 146, line 164, switch A closed to its contact A', line 166, second thermostat switch 162 closed to its contact 162', line 167, switch 104 closed to its upper fixed contact 104', lines 126, 127 and 128, and closed switches 124 and 123 to the $L_1$ side of the power source. It will be appreciated that the above-described circuit conditions result in the timer motor 115 remaining deenergized until the fluid in sump 28 attains the second predetermined temperature which in the disclosed form is 150° F.

Upon the fluid in the sump attaining the second predetermined temperature, 150° F. in the disclosed form, the second thermostat 105 movable contact or switch 162 moves from its first fixed contact 162' to its second fixed contact 162" deenergizing heater 50 and energizing the timer motor 115 causing said timer motor to advance through the remainder of its selected wash cycle with the fluid in the sump having been heated to the second predetermined wash temperature providing the EXTRA HOT WASH TEMP of 150° F. in the preferred form. It will be seen that when the second thermostat switch 162 moves to its second fixed contact 162" upon sensing 150° F. in the disclosed form the timer motor 115 is energized from the $L_2$ side of the power source, lines 148 and 157, timer motor 115, line 156, lines 155 and 154, switch B closed to its contact B", line 168, second thermostat switch 162 closed to contact 162", line 167, switch 104 closed to contact 104', lines 126, 127 and 128, push-pull switch 124 closed to its contact 124', and door switch movable contact 123 closed to its contact 123' to the $L_1$ side of the power source.

Thus, in the embodiment of FIGS. 1–4 applicants' control system provides automatic wash water at 130° F. on all cycles with the option of the customer selection of extra hot 150° F. wash water. The invention automatically saves the user power by turning the dishwasher's heating element 50 off if the incoming water is above 130° F. If the household, however, does not have a water supply in excess of 130° F., the disclosed circuit will sense this fact and provide auxiliary heat until a 130° F. wash temperature is obtained for the POTS AND PANS, NORMAL SOIL, and QUICK Wash periods, as well as supplying heat during the timed rinses if the temperature in these periods is below 130° F. It will be appreciated that a temperature of 130° F. is used for normal washing as this temperature insures more optimum effectiveness of detergents used in the dishwasher.

Figure 5:
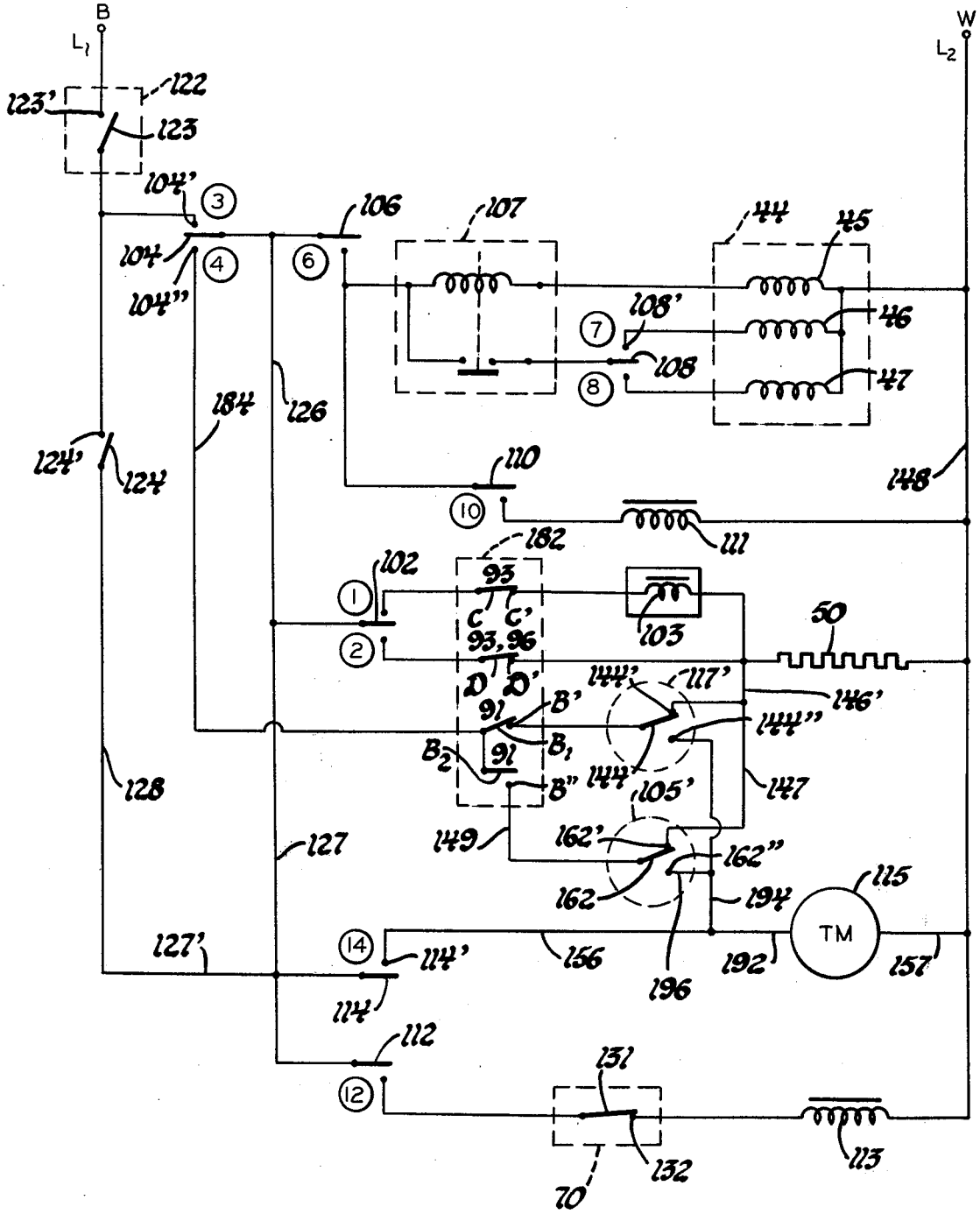
FIG. 5 is a schematic wiring diagram of a second embodiment of the invention for operating the dishwasher of FIG. 1.
Figure 6:
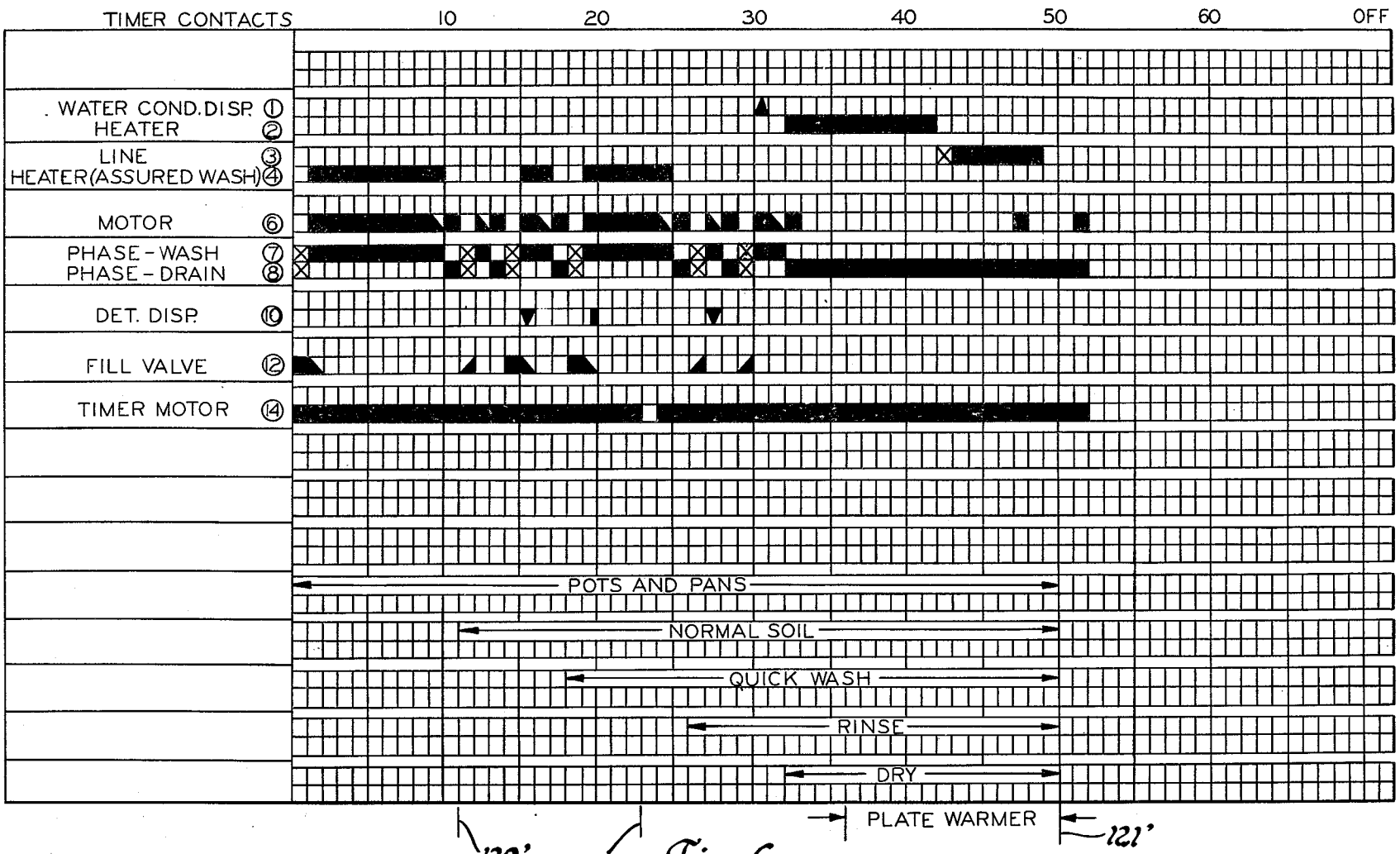
FIG. 6 is a timer cycle chart for the schematic of FIG. 5.

Turning now to an alternative form of the invention disclosed in FIGS. 5 and 6 wherein the corresponding parts of the circuit and corresponding elements are provided with the same reference numerals as used and applied in FIGS. 1–4. Option selector switch 182 of the circuit differs in that the switch portion 91 with contacts A and A' is out and the switch portion 91 with single movable contact B is replaced by the switch portion 91 having a pair of movable contacts $B_1$ and $B_2$.

In accordance with FIG. 5, the various internal switches B, C and D within the option selector switch 182 move to a position opposite that shown when the corresponding option button is selected having the numbers 91–96 (FIG. 2) shown for each of the internal switches $B_1$–D. Thus, double pole-double throw switch $B_1$, $B_2$ move to their opposite positions when the EXTRA HOT-YES button 91 is depressed; single pole-single throw switches C and D move to their opposite positions when RINSE AND HOLD-YES button 93 is depressed; and switch D moves to its opposite position when HEATED DRY-NO button 96 is depressed.

Timer contacts listed in FIG. 6 are shown circled in FIG. 5. It will be noted from the time chart of FIG. 6 that there is no separate timer contact for the 130° thermostat 117' as is the case with contact "sixteen" for thermostat 117 of FIGS. 1–4. The timer 80 includes a timer switch 102 operating between solenoid 103 timer contact "one" and heater 50 timer contact "two"; a timer switch 104 operating between a line contact "three" and a heater (assured wash) contact "four"; timer switch 106 operating to open and close starting relay 107 contact "six"; timer switch 108 operating between motor phase-wash winding 46 timer contact "seven" and motor phase-drain winding 47 timer contact "eight"; timer switch 110 operative to open and close timer detergent dispenser solenoid 111 contact "ten"; timer switch 112 operative to open and close timer fill valve solenoid 113 contact "twelve"; and timer switch 114 operative to open and close timer motor 115 contact "fourteen".

As in the above description the embodiment of FIGS. 5 and 6 will be described in connection with the fill system accompanying the selection of the NORMAL SOIL cycle beginning with the FIG. 6 chart line 120' and terminating at OFF indicated by chart line 121'. As seen in FIG. 5, the dishwashing cycle is initiated through the door switch 122 movable contact 123 which closes to its contact 123' when the door 26 is closed. Upon the timer knob 81 being rotated to its NORMAL SOIL position and pushed-in, the push-pull switch 124 is closed to its fixed contact 124'. With the timer switch 114 closed to its fixed contact 114' at chart line 120', timer motor 115 is energized from $L_1$, door switch 122, push-pull switch 124 and timer motor switch 114. The power supply conductor 128 remains energized throughout the NORMAL SOIL cycle for supplying power to timer motor 115 and, if needed, water valve solenoid 113. At cycle chart line 120' timer switch 112 closes to the contact "twelve" to energize water valve 64 solenoid 113 through water level overfill switch 70 which operates as discussed earlier.

Fill water will start to enter the sump through inlet 66. As in the first embodiment of FIGS. 1–4 applicants' system insures that the temperature of the water in the sump 28 is heated to a minimum first set temperature in the event that the water supplied to the sump is below said first set temperature. As in the embodiment of FIGS. 1–4 the first single pole-double throw thermostat 117' is shown located on sump wall 29 to sense for a minimum first set water temperature of 130° F. in the sump 28.

During wash and rinse periods, power for the heater 50 is provided through timer contact "four" connected by line 184 through movable contact $B_1$ closed to fixed contact B', first thermostat switch 144 closed to fixed contact 144", line 146', heater 50 and line 148 to the $L_2$ side of the power source to provide auxiliary heat to the wash and rinse water. Once the wash or rinse water reaches 130° F., either by being initially above 130° F. or warmed by heater 50, the first thermostat 117' will "open" by moving its switch 144 to its first contact 144" interrupting power to the heater 50.

It will be noted in the timer cycle chart of FIG. 6 that for either the POTS AND PANS, NORMAL SOIL or QUICK WASH cycles, at chart line 186 timer motor contact "fourteen" switch 114 is open. Thus, switch 115 interrupts power to the timer motor 115, resulting in a stoppage of any further timer advancement at line 186 during any of the above named cycles. If the first 130° F. thermostat 117' is contacting its fixed contact 144', power will be fed only to the heater 50 through switch 104 closed to its contact 104". Upon the wash water reaching 130° F. the first thermostat switch 144 closes to its fixed contact 144" whereby power is again supplied to the timer motor 115 via lines 194, line 192, timer motor 115, and thence via lines 157 and 148 to the $L_2$ side of the power source. In this instance the options selector switch 182 has its EXTRA HOT WASH TEMP "NO" button 92 depressed.

If the option selector switch 182 EXTRA HOT WASH TEMP "YES" button 91 is depressed the option selector switch $B_1$ opens from its fixed contact B' and $B_2$ closes to its fixed contact B" whereby the timer motor 115 advancement will be halted at the same point 186 on the FIG. 6 timer chart as described above. With button 91 depressed in the circuit of FIG. 5, the hold condition will be extended until the wash water arrives at a second higher temperature which in the disclosed form is set by the second thermostat 105' at 150° F. This results from the second thermostat 105' switch 162 being in engagement with its first fixed contact 162' whereby heater 50 will be energized via line 148 from the $L_2$ side of the power source, heater 50, line 146', line 147, second thermostat switch 162 closed to its fixed contact 162', line 149, selector switch $B_2$ closed to its contact B", line 184, switch 104 closed to its contact 104", lines 126, 127, 127' and 128; switch 124 closed to its contact 124'; switch movable contact 123 closed to its contact 123' and thence to the $L_1$ side of the power source. Again the timer motor 115 remains deenergized until the fluid in the sump 28 attains the second predetermined temperature which in the disclosed form of FIGS. 5 and 6 is 150° F.

Upon the fluid in the sump attaining the second predetermined temperature, a minimum of 150° F., the second thermostat 105' movable contact or switch 162 moves from its first fixed contact 162' to its second fixed contact 162" deenergizing heater 50 and energizing or restarting the timer motor 115 causing the timer motor to advance through the selected wash cycle with the fluid in the sump heated to the second predetermined wash temperature. It will be seen in FIG. 5 that upon the second thermostat switch 162 moving to its second fixed contact 162" upon sensing a temperature of 150° F. the timer motor 115 is energized from the $L_2$ side of the power source, lines 148, 157, 192, 194 and 196, second thermostat switch 162 closed to its fixed contact 162", line 149, selector switch $B_2$ closed to its contact B", line 184, switch 104 closed to its contact 104", lines 126, 127, 127' and 128; closed movable switch contacts 124 and 123 to the $L_1$ side of the power source.

The control system of FIGS. 5 and 6 provides an EXTRA HOT WASH TEMP of about 150° F. for the entire selected cycle. That is with the form of the invention of FIGS. 5 and 6 each of the thermostats 117' or 105' can be placed alternatively in the circuit resulting in a system having an assured minimum wash water temperature controlled throughout the entire selected cycle by the lower temperature thermostat 117' or an extra hot wash cycle controlled throughout the entire selected cycle by the higher temperature thermostat 105'.

While the embodiment of the present invention as herein disclosed constitutes a preferred form, it is to be understood that other forms might be adopted.

The embodiments of the invention in which an exclusive property or privilege is claimed are defined as follows:

1. In an automatic domestic dishwasher comprising a dishwashing chamber having a sump and an access opening closed by a door, said sump adapted to retain a fluid therein, an electric resistance heater means in said sump and adapted to be inundated by the fluid, fill means for supplying fluid to said chamber and said sump, means for supporting dishes and the like in said chamber, fluid distributing means connected to said sump for circulating the fluid during a wash cycle from said sump over said dishes and the like, a control system for operating said dishwasher including a plurality of timer switches controlled in sequence by a timer, a plurality of electrically operated elements including said fill means controlled by said timer switches to perform said wash and rinse cycles with said fluid, an electrical power source for said control system, said timer including a motor electrically connected to said power source operative to drive said timer switches in said sequence in a predetermined period of time, manually operated options selector switch means in said control system enabling the user to select one of two fluid temperature options during said wash cycle, said control system including first and second single pole-double throw thermostat switches operative for sensing first and second predetermined fluid temperatures respectively, in said sump; said first thermostat switch having its first fixed contact connected to a first fixed contact of a first single pole-double throw switch operated by said options selector switch means, said first thermostat switch having its movable contact connected through certain of said timer switches to one side of said power source, said first thermostat switch having its second fixed contact connected to a common junction means, said common junction means connected to one side of said heater means with the other side of said heater connected to the other side of said power source, said common junction means connected to a contact of a second single pole-single throw options selector switch operated by said options selector switch means, the other contact of said second selector switch connected to a first fixed contact of said second thermostat switch, said second thermostat switch second fixed contact connected to the second fixed contact of said first selector switch, said first selector switch movable contact connected to one side of said timer motor and the other side of said timer motor connected to said other side of said power source, said second thermostat switch having its movable contact connected through certain of said timer switches to said one side of said power source, whereby during normal operation with said options selector switch means moved to a first position and with the timer contact means actuating said fill means fluid is supplied to said pump such that upon actuation of said fluid distributing means said heater means is energized if said first thermostat switch movable contact is in engagement with its second fixed contact, upon the fluid in said sump reaching said first predetermined temperature said first thermostat switch movable contact moves from its second fixed contact to its first fixed contact thereby interrupting power to said heater means and completing the electrical circuit through said first contact of said second selector switch to said timer motor energizing same for advancing said timer through the remainder of the selected wash cycle having assured that the fluid in said sump has been heated to said first predetermined wash temperature to insure optimum performance of the washing fluid, and whereby a higher temperature fluid wash may be manually selected by the user upon moving said options selector switch means to a second position closing said second options selector switch and moving said first options selector switch movable contact from its first fixed contact to its second fixed contact, thereby causing said timer motor to be deenergized, whereby if said second thermostat movable contact is in engagement with its first fixed contact said heater means will be energized and said timer motor will remain deenergized until the fluid in said sump attains said second predetermined temperature, and whereby upon the fluid in said sump attaining said second predetermined temperature said second thermostat movable contact moves from its first fixed contact to its second fixed contact deenergizing said heater means and energizing said timing motor causing said timer to advance through the remainder of said selected wash cycle with the fluid having been heated to said second predetermined wash temperatures providing an extra-hot wash.

2. In an automatic domestic dishwasher comprising a dishwashing chamber having a sump and an access opening closed by a door, said sump adapted to retain a fluid therein, electric resistance heater means in said sump in heat exchange relation with the fluid therein, fill means for supplying fluid to said chamber and said sump, means for supporting dishes and the like in said chamber, fluid distributing means connected to said sump for circulating the fluid during a wash cycle from said sump over said dishes and the like, a control system for operating said dishwasher including a plurality of timer switches controlled in sequence by a timer, a plurality of electrically operated elements including said fill means controlled by said timer switches to perform said wash cycle with said fluid, an electrical power source for said control system, said timer including a motor electrically connectable to said power source and operative to drive said timer switches in said sequence in a predet rmined period of time, manually operated options selector switch means in said control system having first and second positions for enabling the user to select one of normal and higher temperature options during said wash cycle, said control system including first and second single pole-double throw thermostat switches operative to trip upon sensing first and second predetermined fluid operating temperatures respectively, in said sump; said options selector switch means operative in said first position to complete a circuit via said first tripped thermostat switch to energize said timer motor, said options selector switch means operative in said second position to complete a circuit via said second tripped thermostat switch to energize said timer motor, said options selector switch means operative in said first position to energize said heater means via a circuit through said first untripped thermostat, and in said second position to energize said heater means via a circuit through said second untripped thermostat, whereby during normal temperature operation with said options selector switch means moved to said first position and with the timer switch conditioned for actuating said fill means to supply fluid to said sump said heater means is energized and said timer motor is deenergized if said first thermostat swtich senses a temperature below said first predetermined operating temperature, and whereby upon the fluid in said sump reaching said first predetermined operating temperature said first thermostat switch trips thereby interrupting power to said heater means and completing the electrical circuit through said timer motor energizing same for advancing said timer through the remainder of the wash cycle having assured that the fluid in said sump has been heated to said first predetermined wash temperature to assure a desired normal temperature perfotmance of the fluid, and whereby during higher temperature operation with said options selector switch means moved to said second position and with the timer switch conditioned for actuating said fill means to supply fluid to said sump said heater means is energized and said timer motor is deenergized if said second thermostat senses a temperature below said second predetermined operating temperature, and whereby upon the fluid in said sump reaching said second predetermined operating temperature said second thermostat trips thereby interrupting power to said heater means and completing the electrical circuit through said timer motor for energizing said timer motor for advancing said timer through the remainder of the wash cycle having assured that the fluid in said sump has been heated to said second predetermined wash temperature to assure a desired higher temperature performance of the fluid by providing an extra-hot wash.

3. In an automatic domestic dishwasher comprising a dishwashing chamber having a sump and an access opening closed by a door, said sump adapted to retain a fluid therein, electric resistance heater means in said sump and adapted to be inundated by the fluid, fill means for supplying fluid to said chamber and said sump, means for supporting dishes and the like in said chamber, fluid distributing means connected to said sump for circulating the fluid during a wash cycle from said sump over said dishes and the like, a control system for operating said dishwasher including a plurality of timer switches controlled in sequence by a timer, a plurality of electrically operated elements including said fill means controlled by said timer switches to perform said wash and rinse cycles with said fluid, an electrical power source for said control system, said timer including a motor electrically connected to said power source operative to drive said timer switches in said sequence in a predetermined period of time, manually operated options selector switch means in said control system enabling the user to select one of two fluid temperature options during said wash cycle, said control system including first and second single pole-double throw thermostat switches operative for sensing first and second predetermined fluid temperatures respectively, in said sump; said first thermostat switch having its first fixed contact connectable to said timer motor, said first thermostat switch having its movable contact connectable through certain of said timer switches and a fixed contact of a first switch operated by said options selector switch means, said first thermostat switch having its second fixed contact connected to a common junction means, said common junction means connected to one side of said heater means with the other side of said heater connected to the other side of said power source, said second thermostat switch having its first fixed contact connectable to said common junction means and said second fixed contact connectable to one side of said timer motor and the other side of said timer motor connected to said other side of said power source, said second thermostat switch having its movable contact connectable to said one side of said power source through certain of said timer switches and a fixed contact of a second switch operated by said options selector switch means, whereby during normal operation with said options selector switch means moved to a first position and with the timer switch actuating said fill means fluid is supplied to said sump such that upon actuation of said fluid distributing means said heater means is energized if said first thermostat switch movable contact is in engagement with its second fixed contact, upon the fluid in said sump reaching said first predetermined temperature said first thermostat switch movable contact moves from its second fixed contact to its first fixed contact thereby interrupting power to said heater means and completing the electrical circuit through said first switch of said options selector switch to said timer motor energizing same for advancing said timer through the remainder of the selected wash cycle having assured that the fluid in said sump has been heated to said first predetermined wash temperature to insure optimum performance of the washing fluid, and whereby a higher temperature fluid wash may be manually selected by the user upon moving said options selector switch means to a second position closing said second switch of said options selector switch and opening said first switch of said options selector switch, thereby causing said timer motor to be deenergized, whereby if said second thermostat movable contact is in engagement with its first fixed contact said heater means will be energized and said timer motor will remain deenergized until the fluid in said sump attains said second predetermined temperature, and whereby upon the fluid in said sump attaining said second predetermined temperature said second thermostat movable contact moves from its first fixed contact to its second fixed contact deenergizing said heater means and energizing said timing motor causing said timer to advance through the remainder of said selected wash cycle with the fluid having been heated to said second predetermined wash temperatures providing an extra-hot wash.

* * * * *